US012760396B2

(12) United States Patent
Takaya et al.

(10) Patent No.: US 12,760,396 B2
(45) Date of Patent: Oct. 13, 2026

(54) SLAB HAVING EXCEPTIONAL SURFACE CRACK RESISTANCE AND CONTINUOUS CASTING METHOD THEREOF

(71) Applicant: NIPPON STEEL CORPORATION, Tokyo (JP)

(72) Inventors: Shin Takaya, Tokyo (JP); Yuichiro Kato, Tokyo (JP); Kenji Taguchi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 1064 days.

(21) Appl. No.: 17/911,977

(22) PCT Filed: Apr. 5, 2021

(86) PCT No.: PCT/JP2021/014469
§ 371 (c)(1),
(2) Date: Sep. 15, 2022

(87) PCT Pub. No.: WO2021/206045
PCT Pub. Date: Oct. 14, 2021

(65) Prior Publication Data

US 2023/0151467 A1 May 18, 2023

(30) Foreign Application Priority Data

Apr. 7, 2020 (JP) ..... 2020-069306

(51) Int. Cl.

| | |
|---|---|
| ***C22C 38/14*** | (2006.01) |
| ***B22D 11/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |

(52) U.S. Cl.
CPC ..... *C22C 38/14* (2013.01); *B22D 11/001* (2013.01); *C22C 38/001* (2013.01); *C22C 38/02* (2013.01); *C22C 38/04* (2013.01); *C22C 38/06* (2013.01)

(58) Field of Classification Search
None
See application file for complete search history.

(56) References Cited

U.S. PATENT DOCUMENTS

| | | | |
|---|---|---|---|
| 2011/0056592 | A1 | 3/2011 | Arita et al. |
| 2011/0120598 | A1 | 5/2011 | Nonaka et al. |
| 2018/0347025 | A1 | 12/2018 | Shiga et al. |
| 2020/0190617 | A1 | 6/2020 | Hasegawa et al. |
| 2021/0332454 | A1 | 10/2021 | Ono et al. |

FOREIGN PATENT DOCUMENTS

| | | | |
|---|---|---|---|
| JP | 8-73933 | A | 3/1996 |
| JP | 10-130776 | A | 5/1998 |
| JP | 11-236621 | A | 8/1999 |
| JP | 2005-264315 | A | 9/2005 |
| JP | 2007-70660 | A | 3/2007 |
| JP | 2007-70661 | A | 3/2007 |
| JP | 2007-70662 | A | 3/2007 |
| JP | 2008-56991 | A | 3/2008 |
| JP | 2012-31469 | A | 2/2012 |
| JP | 2016-204690 | A | 12/2016 |
| JP | 6347164 | B2 | 6/2018 |
| WO | WO 2009/128428 | A1 | 10/2009 |
| WO | WO 2018/124157 | A1 | 7/2018 |
| WO | WO 2020/045219 | A1 | 3/2020 |

OTHER PUBLICATIONS

U.S. Office Action for U.S. Appl. No. 17/913,367, dated Jun. 13, 2025.
U.S. Office Action for U.S. Appl. No. 17/913,367, dated Mar. 6, 2025.

*Primary Examiner* — Anthony M Liang
(74) *Attorney, Agent, or Firm* — Birch, Stewart, Kolasch & Birch, LLP

(57) ABSTRACT

This slab is a slab of high-Al steel containing C: 0.02 mass % to 0.50 mass % and Al: 0.20 mass % to 2.00 mass %, in which, in a case where [Zr], [Al], and [N] each represent a content (mass %) in the slab, a Zr content satisfies a relationship of $[Zr] \geq 4/3 \times [Al] \times [N]$.

6 Claims, 1 Drawing Sheet

SLAB HAVING EXCEPTIONAL SURFACE CRACK RESISTANCE AND CONTINUOUS CASTING METHOD THEREOF

TECHNICAL FIELD OF THE INVENTION

The present invention particularly relates to a slab of steel containing a large amount of Al and a continuous casting method thereof.

Priority is claimed on Japanese Patent Application No. 2020-069306, filed Apr. 7, 2020, the content of which is incorporated herein by reference.

RELATED ART

In recent years, as high-strength iron and steel materials for thin sheets, a number of alloy steels containing a large amount of Al have been manufactured in order to improve mechanical properties. However, as the amount of Al added increases, in continuous casting, transverse crackings are more likely to be initiated in the surface layers of casting slabs, which has been a problem in terms of operation and product quality.

At straightening points in curved or vertical bending-type continuous casting machines, straightening stress is applied to casting slabs. It is known that transverse crackings are initiated along prior austenite grain boundaries in the surface layers of casting slabs, and straightening stress concentrates on film-like ferrite that is formed along austenite grain boundaries embrittled due to precipitation of AlN, NbC, or the like and prior austenite grain boundaries, whereby transverse crackings are initiated. In addition, these transverse crackings are likely to be initiated particularly in temperature ranges slightly higher than the phase transformation region from austenite to ferrite, but transverse crackings are also initiated even in non-transformation compositions in the same manner. Therefore, usually, a method in which the surface temperature of a casting slab is controlled at a straightening point so as to avoid a temperature region (poor ductility temperature region) where ductility deteriorates and the initiation of transverse crackings is suppressed is adopted.

However, in many cases, it is difficult to control the surface temperature of a casting slab to avoid the poor ductility temperature region because there are significant operational restrictions on attempts therefor. Therefore, Patent Document 1 discloses a technique in which more than 0.010 mass % and 0.025 mass % or less of Ti is added and the surface temperature of a casting slab in the upper portion of a secondary cooling zone where the thickness of a solidified shell of the casting slab is 10 mm to 30 mm is set to equal to or higher than the precipitation start temperature of AlN.

PRIOR ART DOCUMENT

Patent Document

[Patent Document 1] Japanese Patent No. 6347164

DISCLOSURE OF THE INVENTION

Problems to be Solved by the Invention

However, in recent years, in order to further improve mechanical properties, high-Al steel containing 0.20 mass % or more of Al also has been manufactured. An increase in the Al concentration precipitates AlN at higher temperatures and expands the poor ductility temperature region. Therefore, when 0.20 mass % or more of Al is contained, since the poor ductility temperature region is significantly expanded, it is almost impossible in usual operation to avoid poor ductility temperature regions and perform bending and straightening, and it is impossible to avoid transverse crackings. In addition, when 0.50 mass % or more of Al is contained, since the poor ductility temperature region is more significantly expanded, even in operation where cooling conditions have been improved, it is almost impossible to avoid poor ductility temperature regions and perform bending and straightening, and it is impossible to avoid transverse crackings. For slabs where transverse crackings are initiated, not only is maintenance such as a grinder required, but defects attributed to the transverse crackings after hot rolling are also confirmed, which makes it impossible to avoid the deterioration of the yield. An object of the present invention is to provide a slab having exceptional manufacturability that is obtained by continuous casting and does not require maintenance for transverse crackings.

In addition, the method described in Patent Document 1 is applicable to low-carbon aluminum killed steel having an Al concentration of 0.063 mass % to 0.093 mass %, and whether or not this method is effective for high-Al steel containing 0.20 mass % or more of Al is not clear. Addition of a large amount of Ti in accordance with an increase in the Al concentration is conceivable, but a large amount of Ti coarsens TIN and causes a decrease in fatigue strength, and thus there are limitations on the amount of Ti added.

The present invention has been made in consideration of the above-described problems, and an object of the present invention is to provide a slab that is a casting slab of high-Al steel containing 0.20 mass % or more of Al and has exceptional surface crack resistance and a continuous casting method the slab.

Means for Solving the Problem

The present inventors paid attention to the fact that high-temperature embrittlement in casting slabs of high-Al steel is attributed to precipitation of a large amount of AlN and studied the precipitation control of nitrides. Specifically, the high-temperature ductility of steel to which Zr having a higher N-fixing capability than Al was added was investigated. As a result, it was found that addition of a small amount of Zr significantly improves high-temperature ductility. It was found that, since Zr forms ZrN and fixes N immediately after solidification, precipitation of a large amount of AlN in grain boundaries is suppressed, and high-temperature embrittlement of high-Al steel can be fundamentally improved.

Based on what has been described above, the present invention is as described below.

(1)

A slab of high-Al steel containing C: 0.02 mass % to 0.50 mass % and Al: 0.20 mass % to 2.00 mass %, in which a Zr content satisfies the following formula (1).

$$[Zr] \geq 4/3 \times [Al] \times [N] \quad (1)$$

Here, [Zr], [Al], and [N] each represent a content (mass %) in the slab.

(2)

The slab according to (1), in which a mass ratio of ZrN in all nitrides in a surface layer area of the slab is 50.0 mass % or more.

(3)

The slab according to (1) or (2), further containing

Si: 0.20 mass % to 3.00 mass %, and

Mn: 0.50 mass % to 4.00 mass %.

(4)

A continuous casting method of the slab according to any one of (1) to (3), in which, when the slab is straightened, the straightening is performed at a surface temperature within a range of 800° C. to 1000° C.

(5)

The continuous casting method of the slab according to (4), in which an average cooling rate in a surface layer area of the slab is set to 60° C./min or slower.

Effects of the Invention

According to the present invention, it is possible to provide a slab that does not include cracks attributed to straightening stress.

EMBODIMENTS OF THE INVENTION

Hereinafter, the present invention will be described with reference to the drawings. In the present embodiment, numerical ranges expressed using "to" include numerical values before and after "to" as the lower limit and the upper limit. Numerical values expressed using "more than" or "less than" are not included as lower limits or upper limits.

In order to manufacture high-Al steel containing 0.20 mass % or more of Al, it is necessary to prevent the initiation of transverse crackings due to straightening stress at a straightening point during continuous casting. Since it is difficult to deviate temperatures from the poor ductility temperature region at the straightening point, the present inventors studied addition of Zr in order to straighten casting slabs in ordinary temperature ranges at the straightening point.

First Experiment

First, a high-temperature tensile test was performed to confirm the amount of Zr that improves high-temperature ductility. In this test, experiments were performed with two types of steel (slabs), that is, a steel grade A and a steel grade B shown in Table 1. The units of all numerical values indicated in Table 1 are "mass %", and, as shown in Table 1, while the steel grade A does not contain Zr, the steel grade B contains Zr and has almost the same composition as the steel grade A except for Zr. The remainder includes Fe and impurities in all of the types of steel. The "impurity" refers to an element that is contained by accident from ore or scrap that is a raw material or from manufacturing environments or the like at the time of industrially manufacturing the slab.

TABLE 1

| Steel grade | C | Si | Mn | P | S | Ti | Zr | Al | N |
|---|---|---|---|---|---|---|---|---|---|
| A | 0.23 | 1.01 | 2.47 | 0.011 | 0.002 | 0.002 | 0 | 0.70 | 0.0019 |
| B | 0.22 | 1.01 | 2.48 | 0.011 | 0.002 | 0.002 | 0.033 | 0.68 | 0.0020 |

Next, the tensile temperature was changed within a range of 700° C. to 1100° C., and reductions in area (R. A.) were obtained for these two types of steel. Specifically, based on JIS G0567: 2020, cogging was performed on each grade of steel produced by vacuum melting of 25 kg up to ω15 and then made into a ω10 tensile test piece (parallel portion: 90 mm). In the high-temperature tensile test, using a high-frequency induction heating-type high-temperature tensile testing device equipped with a cold crucible, the tensile test piece is melted, then, cooled to a predetermined tensile temperature at a cooling rate of 1.0° C./s, and then pulled until fracture at a strain rate of $3.3\times10^{-4}$ (1/s) while being held at a predetermined tensile temperature. The percentage (%) of a value obtained by dividing the difference between the area of the fractured surface of the tensile test piece after the test and the transverse cross-sectional area of the test piece before the test by the transverse cross-sectional area of the test piece before the test was obtained as the reduction area (reduction in area).

Figure 1:
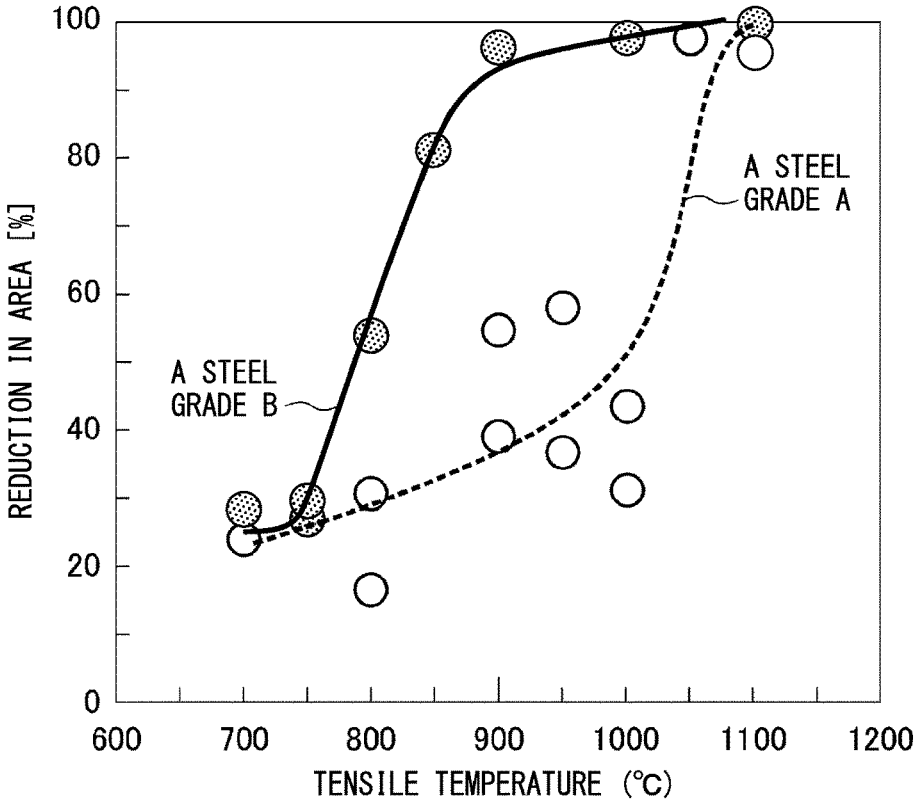
FIG. 1 is a diagram showing changes in reductions in area at tensile temperatures within a range of 700° C. to 1100° C.

The tensile test results are shown in FIG. 1. White circles in FIG. 1 indicate the reductions in area in the steel grade A, and black circles indicate the reductions in area in the steel grade B. As shown in FIG. 1, it was found that the addition of Zr increases the reductions in area particularly in the temperature range of 800° C. to 1000° C. and improves the high-temperature ductility. Here, when R. A. is 50% or more, it can be considered that transverse crackings are not initiated due to straightening stress. Since it is easy in operation to pass slabs through a straightening point at a temperature within a range of 800° C. to 1000° C., addition of Zr makes it possible to prevent transverse crackings even without performing temperature control so as to avoid the poor ductility temperature region.

Second Experiment

Subsequently, a test was performed to confirm the amount of Zr needed in order to prevent transverse crackings. Specifically, a tensile test was performed by setting the tensile temperature to 900° C. and preparing a plurality of samples (No. 1 to No. 12) having different amounts of Al, N, and Zr as shown in Table 2, and R. A.'s (%) were obtained. A specific method of the tensile test is the same as that in the first experiment. The tensile test results are shown in Table 2 and FIG. 2.

TABLE 2

| No. | Al [mass %] | N [mass %] | Al [mass %] × N [mass %] | Zr [mass %] | R.A. [%] (900° C.) |
|---|---|---|---|---|---|
| 1 | 0.2 | 0.0040 | 0.0008 | 0.0050 | 80 |
| 2 | 0.4 | 0.0040 | 0.0016 | 0.0030 | 65 |
| 3 | 0.6 | 0.0035 | 0.0021 | 0.0065 | 70 |
| 4 | 0.8 | 0.0040 | 0.0032 | 0.0050 | 60 |
| 5 | 1.0 | 0.0040 | 0.0040 | 0.0100 | 62 |
| 6 | 2.0 | 0.0030 | 0.0060 | 0.0080 | 55 |
| 7 | 0.2 | 0.0040 | 0.0008 | 0.0010 | 45 |
| 8 | 0.4 | 0.0040 | 0.0016 | 0.0015 | 40 |
| 9 | 0.6 | 0.0040 | 0.0024 | 0.0025 | 45 |
| 10 | 0.8 | 0.0040 | 0.0032 | 0.0030 | 40 |

TABLE 2-continued

| No. | Al [mass %] | N [mass %] | Al [mass %] × N [mass %] | Zr [mass %] | R.A. [%] (900° C.) |
|---|---|---|---|---|---|
| 11 | 1.0 | 0.0040 | 0.0040 | 0.0030 | 30 |
| 12 | 2.0 | 0.0030 | 0.0060 | 0.0050 | 20 |

Figure 2:
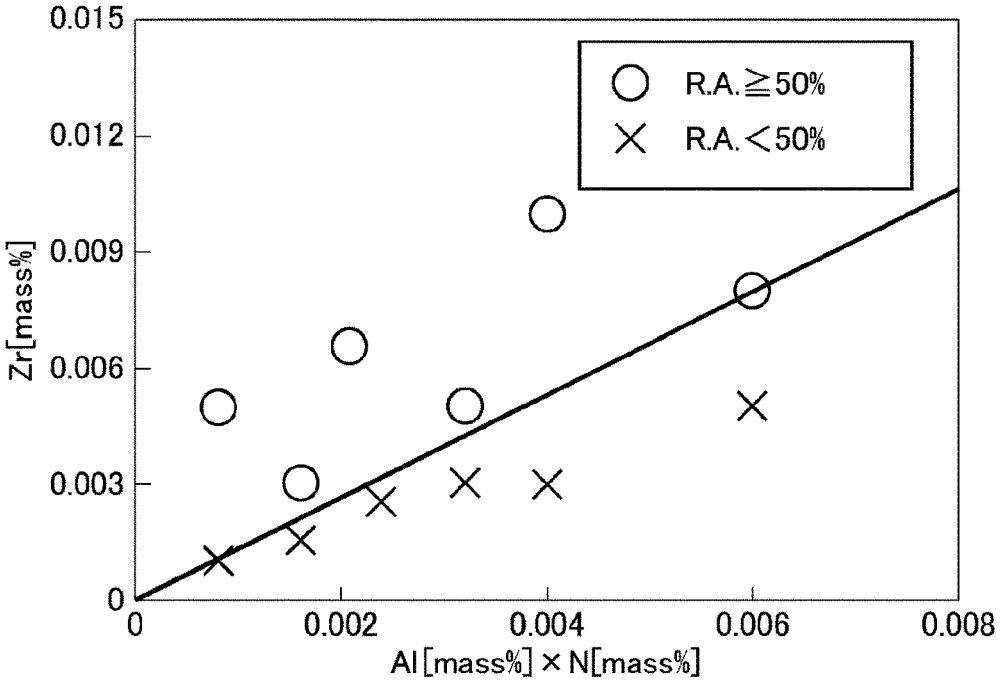
FIG. 2 is a diagram showing a relationship between [Al]×[N] and [Zr] at a tensile temperature of 900° C.

In FIG. 2, as a rough standard for considering that transverse crackings are not initiated, a case where R. A. was 50% or more was evaluated as o, and a case where R. A. was less than 50% was evaluated as x. As a result, it was found that the Zr content correlates with the product of the Al content and the N content. That is, it was found that, when the Zr content is 4/3 times or more the product of the Al content and the N content, R. A. becomes 50% or more, and transverse cracking attributed to straightening stress can be prevented.

Based on the above-described experiment results, the chemical composition of the slab according to the present invention will be described. The slab according to the present embodiment is high-Al steel containing 0.20 mass % to 2.00 mass % of Al and is mainly intended for thin sheet uses. A preferable lower limit of Al is 0.50 mass %. In a case where the Al content is 0.50 mass % or more, since transverse crackings are likely to be initiated as described above, the effect of the present embodiment can be more significantly obtained. In addition, based on the above-described second experiment results, the slab according to the present embodiment contains Zr much enough to satisfy the following formula (1).

$$[Zr] \geq 4/3 \times [Al] \times [N] \quad (1)$$

Here, [Zr], [Al], and [N] each represent the content (mass % with respect to the total mass of the slab) in the slab.

In addition, the upper limit of the Zr content is not particularly limited, however, even when more than 0.1 mass % of Zr is contained, the effect is saturated, and the cost is vainly increased, and thus the Zr content is preferably 0.1 mass % or less. The lower limit of the Zr content is not particularly limited, but is determined from the formula (1), and the Zr content is preferably 0.0010 mass % or more. In addition, the upper limit and the lower limit of the N content are not particularly limited, but the N content is preferably set to 0.0080 mass % or less as a range in which N is contained after a usual refining step and a continuous casting step without intentionally increasing the N content. In addition, when the cost in the refining step is taken into account, the N content is preferably set to 0.0010 mass % or more. In addition, although the present invention relates to high-Al steel, however, when the Al content exceeds 2.00 mass %, the Zr content also increases according to the formula (1), and the cost is vainly increased. Therefore, the Al content is 0.20 to 2.00 mass %, preferably 0.50 to 2.00 mass %, more preferably 0.55 to 2.00 mass %, and still more preferably 0.60 to 2.00 mass %.

As described above, in the slab according to the present embodiment, the relationship among the Zr, Al, and N contents is made to satisfy the condition of the above-described formula (1). Incidentally, the contents of other elements are not particularly limited, but C, Si, and Mn are preferably contained within the following ranges, and it was confirmed that, in the present application, as long as C, Si, Mn, and the like are contained within ranges shown in the present specification, the object of the invention can be achieved.

<C: 0.02 Mass % to 0.50 Mass %>

C is an element that improves the strength of steel, and, when the C content is less than 0.02 mass %, the slab does not satisfy conditions for use as a high strength steel sheet. In addition, when the C content exceeds 0.50 mass %, the hardness becomes excessive, and bendability cannot be guaranteed. Therefore, the C content is set to 0.02 mass % to 0.50 mass %.

<Si: 0.20 Mass % to 3.00 Mass %>

Si is an element that improves the strength of steel, and, when the Si content is less than 0.20 mass %, the slab does not satisfy a use as a high strength steel sheet. In addition, when the Si content exceeds 3.00 mass %, the weldability is adversely affected. Therefore, the Si content is preferably set to 0.20 mass % to 3.00 mass %.

<Mn: 0.50 Mass % to 4.00 Mass %>

Mn is an element that improves the strength of steel, and, when the Mn content is less than 0.50 mass %, the slab does not satisfy a use as a high strength steel sheet. In addition, when the Mn content exceeds 4.00 mass %, since Mn is a segregation element, there is a possibility that the strength may become uneven in casting slabs or steel sheets. Therefore, the Mn content is preferably set to 0.50 mass % to 4.00 mass %. The remainder other than the above-described elements is iron and impurities, but the slab may contain several components instead of some of the iron. Here, the "impurity" refers to, as described above, an element that is contained by accident from ore or scrap that is a raw material or from manufacturing environments or the like at the time of industrially manufacturing the slab. Therefore, the slab according to the present embodiment contains, by mass %, for example, Al: 0.20% to 2.00%, Zr: 0.1% or less, N: 0.0010% to 0.0080%, C: 0.02% to 0.50%, Si: 0.20% to 3.00%, Mn: 0.50% to 4.00%, P: 0.0005% to 0.1%, S: 0.0001% to 0.05%, Mo: 0% to 0.1%, Nb: 0% to 0.1%, V: 0% to 0.1%, B: 0% to 0.005%, Cr: 0% to 0.1%, Ni: 0% to 0.5%, Cu: 0% to 0.5%, and a remainder including iron and the impurities and, furthermore, satisfies the above-described formula (1).

Furthermore, as described above, since Zr forms ZrN and fixes N immediately after solidification, precipitation of a large amount of AlN in grain boundaries is suppressed, high-temperature embrittlement of high-Al steel can be fundamentally improved, and it becomes possible to avoid transverse cracking in the slab. From such a viewpoint, the mass ratio of ZrN in all nitrides in the 5 mm surface layer area where the surface structure of the slab is uniformly present is preferably 50.0 mass % or more, more preferably 60.0 mass % or more, and still more preferably 75.0 mass % or more.

Here, the mass ratio of ZrN in the surface layer area of the slab is measured by the following method. A sample for observing the surface layer of the casting slab (for example, a sample that is 25 mm in width, 25 mm in length and 25 mm in thickness from the widthwise center of the casting slab) is cut out from the manufactured slab, and the surface at a depth position of 5 mm from the surface of the casting slab is mirror-polished, thereby preparing an observed section. Next, the exposed surface (observed section) is observed with a scanning electron microscope with an energy dispersive X-ray analyzer (SEM/EDS). Element mapping on the observed section is performed by the observation, and all nitrides having a size of 200 to 5000 nm (equivalent circle diameter) on the observed section are specified. Here, examples of nitrides that can be observed include ZrN, AlN, TiN, NbN, BN, VN, and the like. In addition, with an assumption that all of the nitrides are uniformly distributed in the surface layer area of the slab, the area proportion of ZrN in all of the nitrides obtained based on the specification results can be regarded as the volume fraction, and the mass ratio of ZrN in all of the nitrides is obtained from the volume fraction. ZrN is defined as a nitride containing 50 mass % or more of Zr with respect to the total mass of nitride particles.

Next, a continuous casting method of the above-described slab will be described. In the present embodiment, since there is no need to avoid the poor ductility temperature region, it is possible to use, particularly, an ordinary method in continuous casting. The results of the above-described first experiment show that, at the time of straightening the casting slab, in a case where the straightening is performed when the surface temperature of the casting slab is 800° C. to 1000° C., particularly, the effect becomes significant, which is preferable.

Here, the average cooling rate in the surface layer area of the slab is preferably set to 120° C./min or slower and more preferably set to 60° C./min or slower. In this case, the mass ratio of ZrN in the surface layer area can be set to 50.0 mass % or more. In particular, when the average cooling rate in the surface layer area of the slab is set to 60° C./min or slower, it is possible to set the mass ratio of ZrN in the surface layer area to 60.0 mass % or more. The average cooling rate in the surface layer area of the slab is measured by the following method. That is, the temperature of the surface of the slab in the center portion in the width direction is measured by a thermocouple or the like, and the average cooling rate from 1450° C. to 1000° C. at a position 5 mm deep from the position (measurement position) is calculated by two-dimensional heat transfer calculation. Specifically, the difference between these temperatures (450° C.) is divided by the time necessary to cool the temperature at the measurement position from 1450° C. to 1000° C. Therefore, the average cooling rate in the surface layer area of the slab is measured. The average cooling rate in the surface layer area of the slab can be adjusted with the amount of secondary cooling water. The lower limit of the average cooling rate needs to be, for example, 20° C./min.

EXAMPLES

Next, examples of the present invention will be described, but these conditions are examples of conditions adopted to confirm the feasibility and effect of the present invention, and the present invention is not limited to the description of these examples. The present invention can be performed by a variety of means for achieving the object of the present invention without departing from the gist of the present invention.

Sixteen types of molten steel having a C content of 0.3 mass %, a Si content of 1.5 mass %, a Mn content of 2.0 mass %, and an Al content, a N content, and a Zr content that were mutually different were prepared, each poured into a mold, and continuously cast with a continuous casting machine. As the continuous casting machine, a vertical bending-type continuous casting machine having mold sizes that were 250 mm in thickness and 1200 mm in width was used, and the casting speed was set to 1.2 m/min. In addition, at a straightening point, the surface temperatures of all casting slabs were set to 850° C. In addition, the average cooling rates in the surface layer areas were set to values shown in Table 3 (60° C./min or 120° C./min).

In each of the slabs produced under the above-described conditions, the mass ratio of ZrN in the surface layer area of the slab was measured by the above-described method. Furthermore, in some of the slabs, the reductions in area (R. A.) (%) at 900° C. were obtained in the same manner as in the first experiment. Furthermore, transverse crackings in the slabs were evaluated according to the following evaluation criteria. That is, after the front and rear surfaces of the slab were ground 0.7 mm, and then the presence or absence of transverse crackings was visually confirmed. Furthermore, slabs from which transverse crackings could not be confirmed were heated to 1200° C. in a heating furnace in a hot rolling step without performing any maintenance for a defect, roughly rolled, hot-rolled under conditions of a finish temperature of 880° C. and a sheet thickness of 2.8 mm, and the presence or absence of defects attributed to transverse crackings after the hot rolling was visually confirmed. Slabs where no defects attributed to transverse crackings were confirmed even after the hot rolling were evaluated as very good (VG), slabs where defects attributed to transverse crackings could be confirmed after the hot rolling were evaluated as good (G), and slabs where transverse crackings could be confirmed before the hot rolling were evaluated as bad (B). The experiment results are shown in Table 3.

TABLE 3

| | Sample No. | Al [mass %] | N [mass %] | Al [mass %] × [mass %] | Zr [mass %] | Right side of formula (1) | [Zr] - right side of formula (1) | Cooling rate (° C./min) | Reduction in area RA [%] at 900° C. | ZrN proportion in nitrides (%) | Cracks in slab | Defect after hot rolling | Comprehensive evaluation of surface cracks |
|---|---|---|---|---|---|---|---|---|---|---|---|---|---|
| Present | 1 | 0.20 | 0.0040 | 0.00080 | 0.0050 | 0.0011 | 0.0039 | Slow | 80.0 | 70.0 | No | No | VG |
| Invention | 2 | 0.40 | 0.0035 | 0.00140 | 0.0030 | 0.0019 | 0.0011 | cooling | 65.0 | 60.0 | | | VG |
| Example | 3 | 0.50 | 0.0032 | 0.00160 | 0.0060 | 0.0021 | 0.0039 | 60° C./ | — | 65.0 | | | VG |
| | 4 | 0.60 | 0.0034 | 0.00204 | 0.0090 | 0.0027 | 0.0063 | min | — | 85.0 | | No | VG |
| | 5 | 0.70 | 0.0032 | 0.00224 | 0.0050 | 0.0030 | 0.0020 | | 70.0 | 80.0 | | | VG |
| | 6 | 0.80 | 0.0036 | 0.00288 | 0.0040 | 0.0038 | 0.0002 | | 60.0 | 75.0 | | | VG |
| | 7 | 1.00 | 0.0030 | 0.00300 | 0.0120 | 0.0040 | 0.0080 | | — | 85.0 | | | VG |
| | 8 | 2.00 | 0.0028 | 0.00560 | 0.0080 | 0.0075 | 0.0005 | | 55.0 | 75.0 | | | VG |
| | 9 | 0.85 | 0.0050 | 0.00425 | 0.0250 | 0.0057 | 0.0193 | | — | 85.0 | | | VG |

TABLE 3-continued

| | Sample No. | Al [mass %] | N [mass %] | Al [mass %] × [mass %] | Zr [mass %] | Right side of formula (1) | [Zr] - right side of formula (1) | Cooling rate (° C./min) | Reduction in area RA [%] at 900° C. | ZrN proportion in nitrides (%) | Cracks in slab | Defect after hot rolling | Comprehensive evaluation of surface cracks |
|---|---|---|---|---|---|---|---|---|---|---|---|---|---|
| | 10 | 1.20 | 0.0045 | 0.00540 | 0.0410 | 0.0072 | 0.0338 | | — | 90.0 | | | VG |
| | 11 | 0.50 | 0.0033 | 0.00165 | 0.0060 | 0.0022 | 0.0038 | Rapid cooling | — | 50.0 | No | Yes | G |
| | 12 | 0.60 | 0.0035 | 0.00210 | 0.0090 | 0.0028 | 0.0062 | 120° C./min | — | 55.0 | | | G |
| Comparative Example | 1 | 0.50 | 0.0040 | 0.00200 | 0.0010 | 0.0027 | −0.0017 | 60° C./min | — | 35.0 | Yes | — | B |
| | 2 | 0.70 | 0.0040 | 0.00280 | 0.0020 | 0.0037 | −0.0017 | | 30.0 | 30.0 | | | B |
| | 3 | 1.50 | 0.0030 | 0.00450 | 0.0035 | 0.0060 | −0.0025 | | — | 30.0 | | | B |
| | 4 | 2.00 | 0.0030 | 0.00600 | 0.0030 | 0.0080 | −0.0050 | | 25.0 | 20.0 | | | B |

Underlined values do not satisfy the formula (1).

Zr [mass %] ≥4/3 Al [mass %] × N [mass %] · · · (1)

Underlines in Table 3 indicate examples where the conditions of the present invention are not satisfied. As shown in Table 3, in a case where the condition of the formula (1) was satisfied, transverse cracks were not present regardless of the Al or N content. On the other hand, in a case where the formula (1) was not satisfied, it was considered that Zr was insufficient and a large amount of AlN remained, and transverse crackings were initiated. In a case where the formula (1) was not satisfied, the mass ratio of ZrN in the surface layer area of the slab was also below 50.0 mass %.

Furthermore, when the average cooling rate in the surface layer area of the slab was set to 60° C./min or slower, it was possible to set the mass ratio of ZrN in the surface layer area of the slab to 60 mass % or more. In this case, no defects attributed to transverse crackings were confirmed even after hot rolling. On the other hand, in a case where the average cooling rate in the surface layer area of the slab became 120° C./min, the mass ratio of ZrN in the surface layer area of the slab became 50.0 mass % or more and less than 60.0 mass %. In this case, no transverse crackings were confirmed before hot rolling, but defects attributed to transverse crackings were confirmed after hot rolling.

Hitherto, the preferred embodiment of the present invention has been described in detail with reference to the accompanying drawings, but the present invention is not limited to such examples. It is evident that a person skilled in the art of the present invention is able to conceive a variety of modification examples or correction examples within the scope of the technical concept described in the claims, and it is needless to say that such examples are also understood to be in the technical scope of the present invention.

The invention claimed is:

1. A slab of high-Al steel comprising:

C: 0.02 mass % to 0.50 mass %; and

Al: 0.20 mass % to 2.00 mass %, wherein a Zr content satisfies the following formula (1), $$[Zr] \geq 4/3 \times [Al] \times [N] \quad \text{formula (1)}$$

here, [Zr], [Al], and [N] each represent a content, in mass %, in the slab, and wherein a mass ratio of ZrN in all nitrides with a circle equivalent diameter of 200 to 5000 nm in a surface layer area of the slab is 60.0 mass % or more.

2. The slab according to claim 1, further comprising:

Si: 0.20 mass % to 3.00 mass %; and

Mn: 0.50 mass % to 4.00 mass %.

3. A continuous casting method of the slab according to claim 1, wherein the method comprises straightening the slab at surface temperature within a range of 800°C and 1000°C.

4. A continuous casting method of the slab according to claim 2, wherein the method comprises straightening the slab at surface temperature within a range of 800°C and 1000°C.

5. The continuous casting method according to claim 3, wherein an average cooling rate in a surface layer area of the slab is set to 60°C/min or slower.

6. The continuous casting method according to claim 4, wherein an average cooling rate in a surface layer area of the slab is set to 60°C/min or slower.

* * * * *